US007954799B2

(12) United States Patent
Honmochi et al.

(10) Patent No.: US 7,954,799 B2
(45) Date of Patent: Jun. 7, 2011

(54) BOOKBINDING APPARATUS, BOOKBINDING SYSTEM AND IMAGE FORMATION PROCESSING SYSTEM

(75) Inventors: Hiroki Honmochi, Moriya (JP); Masayoshi Kubo, Toride (JP); Toshiaki Nochi, Mitsukaido (JP); Ken Yonekawa, Moriya (JP); Yuji Ueno, Moriya (JP); Keiichi Nagasawa, Alps (JP); Hiroshi Nakagomi, Alps (JP)

(73) Assignees: Canon Finetech Inc., Ibaraki-ken (JP); Nisca Corporation, Yamanashi-ken (JP)

( * ) Notice: Subject to any disclaimer, the term of this patent is extended or adjusted under 35 U.S.C. 154(b) by 0 days.

(21) Appl. No.: 12/709,869

(22) Filed: Feb. 22, 2010

(65) Prior Publication Data

US 2010/0187743 A1 Jul. 29, 2010

Related U.S. Application Data

(60) Division of application No. 12/169,809, filed on Jul. 9, 2008, now Pat. No. 7,694,948, and a continuation of application No. 11/111,284, filed on Apr. 20, 2005, now Pat. No. 7,413,179.

(30) Foreign Application Priority Data

Apr. 21, 2004 (JP) ..... 2004-125602
May 28, 2004 (JP) ..... 2004-158721

(51) Int. Cl.
*B65H 37/04* (2006.01)

(52) U.S. Cl. ..... 270/58.08; 270/58.07; 270/58.11; 412/8; 412/16; 412/37

(58) Field of Classification Search ..... 270/58.07, 270/58.08, 58.11, 58.13, 58.28; 412/8, 16, 412/18, 33, 37
See application file for complete search history.

(56) References Cited

U.S. PATENT DOCUMENTS

| | | | | |
|---|---|---|---|---|
| 5,108,244 | A * | 4/1992 | Bellanca | 412/37 |
| 5,540,421 | A | 7/1996 | Ohta et al. | |
| 6,027,107 | A | 2/2000 | Natsume et al. | |
| 6,220,592 | B1 * | 4/2001 | Watanabe et al. | 271/241 |
| 6,575,447 | B2 * | 6/2003 | Yoshie et al. | 270/58.07 |
| 2001/0019191 | A1 * | 9/2001 | Yoshie et al. | 270/52.17 |

FOREIGN PATENT DOCUMENTS

| | | |
|---|---|---|
| EP | 1275522 | 1/2003 |
| JP | 2001240301 | 9/2001 |
| JP | 2002326473 | 11/2002 |

* cited by examiner

*Primary Examiner* — Leslie A Nicholson, III
(74) *Attorney, Agent, or Firm* — Michaud-Kinney Group LLP

(57) ABSTRACT

In a bookbinding apparatus, an adhesive applying portion applies an adhesive to an end face of a sheet bundle allowed to stand in the substantially vertical direction, a storage portion that gathers and stores the sheet bundle which is applied with the adhesive and bound in the adhesive applying portion while letting the sheet bundle stand in the substantially vertical direction, transport means for conveying the sheet bundle while letting the sheet bundle stand in the substantially vertical direction from the adhesive applying portion to the storage portion along a substantially vertical transport path, and a cutting portion which is provided on the transport path between the adhesive applying portion and the storage portion, and which cuts an end face of the sheet bundle while letting the sheet bundle stand in the substantially vertical direction.

10 Claims, 6 Drawing Sheets

BOOKBINDING APPARATUS, BOOKBINDING SYSTEM AND IMAGE FORMATION PROCESSING SYSTEM

CROSS-REFERENCE TO RELATED APPLICATION

This application is a divisional application of U.S. patent application Ser. No. 12/169,809 filed Jul. 9, 2008, which is a continuation application of U.S. patent application Ser. No. 11/111,284 filed Apr. 20, 2005, the subject matter of these patent documents are incorporated by reference herein in their entirety.

BACKGROUND OF THE INVENTION

1. Field of the Invention

The present invention relates to a bookbinding apparatus for placing a sheet with an image formed thereon on a tray and binding a bundle of placed sheets, and to an image formation processing system provided with such bookbinding means.

2. Description of Related Art

In a conventional bookbinding apparatus for image formed sheets, a plurality of sheets is gathered in the shape of a bundle to form a sheet bundle, an adhesive is applied to one end face of the formed sheet bundle, and a front cover is bonded to the end face of the sheet bundle applied with the adhesive. Further, the bookbinding apparatus is usually provided with a cutting portion that cuts the end face of the sheet bundle to a predetermined size, and a storage portion that stores bound sheet bundles while stacking the bundles (for example, see Patent Documents 1 and 2).

Further, an image formation processing system has conventionally been known for forming an image on a sheet, placing the sheet with the image formed thereon on a tray, and performing the aforementioned bookbinding processing on a bundle of placed sheets. As an example of such an image formation processing system, Patent Document 3 discloses an image formation processing system integrally provided with an image formation portion that forms an image and transfers the image to a sheet, a post-processing portion that performs predetermined post-processing on the sheet with the image transferred in the image formation portion, and a gluing processing portion that performs gluing processing on the sheet with the image transferred thereto.

[Patent Document 1] JP2001-240301

[Patent Document 2] JP2002-326473

[Patent Document 3] U.S. Pat. No. 5,540,421

However, in such a conventional bookbinding apparatus, the sheet bundle is conveyed in various directions and bound. More specifically, for example, the sheet bundle is conveyed while lying (in the direction along the end face of the sheet bundle), and/or conveyed in an oblique direction, thereby achieving application of adhesive, cutting and storage. Therefore, various problems have occurred as described below.

7oblique directions in the bookbinding apparatus, the need arises for securing space to convert a posture of the sheet bundle in the bookbinding apparatus, and further, an area increases occupied by transport paths for sheet bundles in the bookbinding apparatus. In other words, it is necessary to secure a large volume of space for transport paths of sheet bundles in the bookbinding apparatus, and the bookbinding apparatus is increased in size, resulting in a problem of increasing manufacturing cost of the bookbinding apparatus.

Further, when an adhesive is applied to an end face of a sheet bundle in a state where the sheet bundle is lying (horizontal state), the adhesive needs to be applied from the side to the end face of the sheet bundle, and it is required to improve the structure to apply the adhesive uniformly with excellence. For example, when an adhesive is applied from the side to the end face of the sheet bundle from an adhesive applying device provided with a container that stores the adhesive, in order to prevent the adhesive to apply from leaking from the container due to the effect of gravity, it is necessary to provide the container with a sealing structure. Therefore, the adhesive applying device in the conventional apparatus has been complicated in structure.

Furthermore, in conveying the sheet bundle applied with the adhesive while letting the sheet bundle lie, when the sheet bundle has been applied with a large amount of the adhesive, or conveyed while being inclined, there is the fear that such a problem may occur that the end face of the sheet bundle comes into contact with various members including a side wall of the transport path while being conveyed, and the adhesive coated on the end face of the sheet bundle is thereby removed. In order to prevent such a problem, devices are considered such as securing sufficient space between the end face of the sheet bundle applied with the adhesive and the transport path, and providing specific equipment for precisely controlling an application amount of the adhesive. However, these cases result in increases in size and cost of the apparatus.

Moreover, when an adhesive is applied to a sheet bundle, a front cover is bonded thereto, and the end face of the sheet bundle is cut while letting the sheet bundle lie, since the direction (vertical direction) in which the adhesive spills and drips from the front cover due to gravity agrees with the direction in which a cutting blade moves, the spilled adhesive is apt to adhere to the cutting blade, and there has been the fear that the adhered adhesive degrades subsequent cutting function of the cutting blade.

Further, in the case of storing bound sheet bundles while letting the bundles lie (horizontal state), since the direction (vertical direction) in which the adhesive drips due to gravity agrees with the direction in which the sheet bundles are stacked, such a problem has occurred that the dripped adhesive bonds sheet bundles.

Furthermore, in the image formation processing system as described in Patent Document 3, transport paths are provided to convey a sheet between processing portions. However, a transport path to convey a sheet from the image formation portion to the gluing processing portion is provided independently of a transport path to convey a sheet from the image formation portion to the post-processing portion via the gluing processing portion, and further, a transport path for a sheet to undergo processing in the gluing processing portion functions independently of a transport path for a sheet to undergo processing in the post-processing portion. Therefore, transport paths are complicated, and the ratio of transport paths occupying in the space is large in the apparatus. Thus, in the conventional system, the internal mechanism is complicated, the entire size is large, and it is extremely difficult to reduce manufacturing cost of the system.

SUMMARY OF THE INVENTION

In view of the various problems of the conventional techniques in the foregoing, it is an object of the present invention to provide a bookbinding apparatus and bookbinding system with a simple structure and compact size enabling bookbinding processing without any problems with dripping of an adhesive and the like.

It is another object of the invention to provide an image formation processing system which simplifies transport paths and their structures to decrease the size of the entire apparatus, while reducing the cost.

In order to achieve the objects, a bookbinding apparatus according to the present invention is a bookbinding apparatus which gathers a plurality of sheets in the shape of a bundle to form a sheet bundle and binds the sheet bundle, and has an adhesive applying portion that applies an adhesive to an end face of the sheet bundle allowed to stand in the substantially vertical direction, a storage portion that gathers and stores the sheet bundle which is applied with the adhesive and bound in the adhesive applying portion, while letting the sheet bundle stand in the substantially vertical direction, and transport means for conveying the sheet bundle while letting the sheet bundle stand in the substantially vertical direction from the adhesive applying portion to the storage portion along a substantially vertical transport path.

By this means, in the bookbinding apparatus, the sheet bundle is conveyed from the adhesive applying portion to the storage portion along the substantially vertical transport path while being allowed to stand in the substantially vertical direction. In other words, the sheet bundle is conveyed along only the substantially vertical straight-line transport path over generally all the processes of the bookbinding processing, without being conveyed in various directions such as the vertical, horizontal and oblique directions in the bookbinding apparatus. Therefore, it is not necessary to secure space to convert a posture of the sheet bundle in the bookbinding apparatus, and an area occupied by the transport path for the sheet bundle is remarkably reduced in the bookbinding apparatus, as compared with the conventional bookbinding apparatus that conveys the sheet bundle in various directions such as the vertical, horizontal and oblique directions. Accordingly, it is possible to miniaturize the bookbinding apparatus and largely reduce the manufacturing cost of the bookbinding apparatus. Further, the sheet bundle is maintained while being allowed to stand in the substantially vertical direction during transport from the adhesive applying portion to the storage portion, and therefore, does not crumble.

Moreover, in the bookbinding apparatus, an adhesive is applied to an end face of the sheet bundle while letting the sheet bundle stand in the substantially vertical direction. In other words, it is possible to apply the adhesive to the end face of the sheet bundle in the vertical direction, and it is not necessary to apply the adhesive from the side, thereby eliminating the need of daring to devise the structure to prevent the adhesive to apply from leaking from the adhesive container due to the effect of gravity. It is thus possible to simplify the structure of the adhesive applying device and coat the adhesive uniformly with excellence.

In the bookbinding apparatus, the sheet bundle applied with the adhesive is conveyed in the substantially vertical direction without being conveyed while lying. In other words, the sheet bundle is conveyed in the direction perpendicular to the direction along the end face coated with the adhesive, and it is thus possible to prevent the end face of the sheet bundle in transport from coming into contact with various members including side walls of the transport path. Accordingly, such a problem can be prevented that the adhesive applied to the end face of the sheet bundle is removed. Further, the need is eliminated for taking measures against such a problem, not resulting in increases in size and cost of the apparatus.

Furthermore, according to the bookbinding apparatus, the sheet bundle which is applied with the adhesive and bound is stored and gathered while being allowed to stand in the substantially vertical direction. In this way, since the direction in which the adhesive applied to the sheet bundle drips due to gravity is different from (substantially perpendicular to) the direction in which the sheet bundles are gathered, even if the adhesive drips in the storage portion, the dripped adhesive is prevented from boding sheet bundles. In this case, particularly as described in claim 5, it is preferable to gather and store sheet bundles with the end face coated with the adhesive down in the storage potion. It is thus possible to reliably prevent the dripped adhesive from bonding sheet bundles.

The bookbinding apparatus of the invention is further provided with a cutting portion which is provided on the transport path between the adhesive applying portion and the storage portion, and which cuts an end face of the sheet bundle while letting the sheet bundle stand in the substantially vertical direction.

By this means, in the bookbinding apparatus, since the sheet bundle applied with the adhesive undergoes cutting of its end face while standing in the substantially vertical direction, the direction (vertical direction) of the adhesive dripping due to gravity is perpendicular to the cutting direction (shift direction) of a cutting blade. Accordingly, as compared to the case where the adhesive dripping direction agrees with the cutting direction (shift direction) of the cutting blade (the case where the sheet bundle is cut while lying horizontally), occasions can be reduced extremely such that the adhesive dripped in cutting adheres to the cutting blade, and it is made possible to minimize such an event that the adhered adhesive degrades subsequent cutting function of the cutting blade.

The bookbinding apparatus is further provided with a front cover bonding portion which is provided on the transport path between the adhesive applying portion and the storage portion, and which bonds a front cover to the end face of the sheet bundle applied with the adhesive while letting the sheet bundle stand in the substantially vertical direction.

In this way, in the bookbinding apparatus, a front cover is bonded to the end face of the sheet bundle applied with the adhesive, while letting the sheet bundle stand in the substantially vertical. Therefore, when bonding is carried out such that the sheet bundle is pressed against the front cover with the end face coated with the adhesive down, even if the adhesive drips, the adhesive is received on the front cover, and the risk is eliminated of occurrences of trouble due to the adhesive adhering to other parts of the apparatus.

Moreover, in the bookbinding apparatus, the transport means conveys the sheet bundle with the end face coated with the adhesive down. Thus, in the bookbinding apparatus, since the sheet bundle is conveyed with the end face down on which the adhesive is coated, it does not happen that the adhesive is removed due to the fact that the end face of the sheet bundle comes into contact with the transport path while the sheet bundle is moved, without particularly securing large space for the transport path, or without providing specific equipment for precisely controlling an application amount of the adhesive. Accordingly, without resulting in increases in size and cost of the apparatus, it is possible to bond sheets constituting the sheet bundle with reliability and bond the sheet bundle and the front cover adequately. Further, such a failure does not occur that the adhesive adhered to the side wall of the transport path prevents transport of subsequent sheet bundles.

Moreover, by facing the end face coated with the adhesive downwardly, it is possible to apply the adhesive from under the end face, and the adhesive container can be released upwardly. Therefore, it is also made possible to replenish the adhesive in the adhesive container in the gravity direction, facilitating replenishment of the adhesive.

The invention further provides an image formation processing system provided with an image formation portion that forms an image on a sheet, a sheet receiving portion that receives a plurality of sheets with images transferred thereto from the image formation portion, a bookbinding section having a gathering portion that receives a plurality of sheets with images transferred thereto from the image formation portion, while gathering the received sheets in the shape of a bundle to form a sheet bundle, and a front cover bonding portion that bonds a front cover to an end face of the sheet bundle with an adhesive, and transport means for conveying the sheet from the image formation portion to the bookbinding section and the sheet receiving portion, where the bookbinding section is disposed downstream of the image formation portion in sheet transport, the sheet receiving portion is disposed downstream of the bookbinding section in sheet transport, the transport means has a first transport path extending from the image formation portion to the bookbinding section, a second transport path to be coupled to the first transport path while reaching the gathering portion, a third transport path to be coupled to the first transport path while reaching the sheet receiving portion via the bookbinding section, and switching means for selectively connecting the first transport path to the second transport path or the third transport path, and the front cover boding portion is provided on the third transport path.

Thus, in the image formation processing system according to the invention, the third transport path serves both as a transport path for conveying a sheet from the image formation portion or sheet supplying portion to the sheet receiving portion via the bookbinding section, and as a transport path for conveying a front cover from the image formation portion or sheet supplying portion to the front cover bonding portion, and thus is shared effectively between the bookbinding section and the sheet receiving portion. In the image formation processing system, transport paths are thus simplified, thereby implementing miniaturization in the system and reduction in manufacturing cost thereof.

In addition, in the image formation processing system, the sheet receiving portion may be configured as a post-processing portion which gathers sheets received from the image formation portion in the shape of a bundle to form a sheet bundle and performs predetermined post-processing on the sheet bundle, or may be merely a storage tray without the post-processing function. Further, in the configuration as described above, the third transport path preferably extends substantially horizontally without bending. By forming the third transport path related to the front cover bonding portion in a substantially horizontal shape, the transport path is prevented from being clogged with tough thick paper likely used as a front cover while conveying such thick paper to the front cover bonding section, and it is possible to supply the cover to the front cover bonding portion with reliability.

In the image formation processing system, after being created in the image formation portion, the front cover may be supplied to the front cover bonding portion via the first and third transport paths, or may be supplied to the front cover bonding portion from front cover supplying means provided independently of the image formation portion via the first and third transport paths. Further, in the configuration, the post-processing portion may gather sheets received via the third transport path in the shape of a bundle to form a sheet bundle, and perform operation to staple the sheet bundle. Furthermore, the post-processing portion may gather sheets received via the third transport path in the shape of a bundle to form a sheet bundle, and perform operation to punch holes in the sheet bundle.

According to the invention, a bookbinding apparatus and bookbinding system are implemented that are simple in structure, compact in size, and allowed to perform bookbinding processing without any problems with dripping of an adhesive, while an image formation processing system is implemented which simplifies transport paths and thereby reduces the size of the entire structure.

BRIEF DESCRIPTION OF THE DRAWINGS

FIG. 5(*b*) shows the cutting portion and the flapper at the time of cutting.

DETAILED DESCRIPTION OF THE PREFERRED EMBODIMENTS

Embodiments of the present invention will specifically be described below with reference to accompanying drawings.

Figure 1:
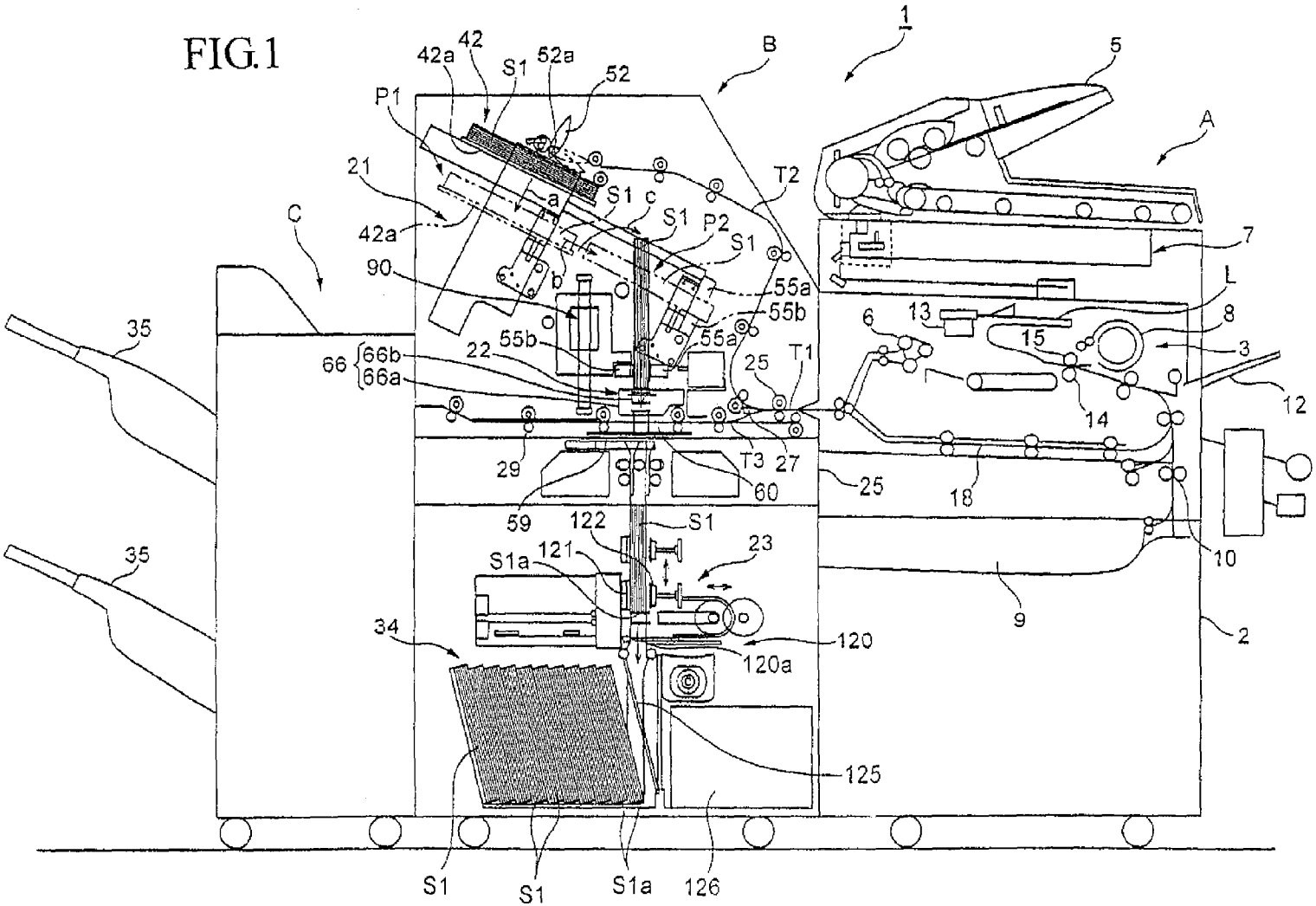
FIG. 1 is a view showing a schematic configuration of a bookbinding system according to one embodiment of the present invention.

FIG. 1 shows a bookbinding system 1 provided with a copy machine A as an image formation apparatus according to the invention, a bookbinding apparatus B and a post-processing apparatus C according to one embodiment of the invention. The bookbinding apparatus B receives a plurality of sheets with images transferred thereto from the copy machine A, gathers the received sheets in the shape of a bundle to form a sheet bundle, and binds the sheet bundle. The post-processing apparatus C has a discharge tray 35, receives a plurality of sheets with images transferred to thereto from the copy machine A via the bookbinding apparatus B, and forms a sheet bundle while performing post-processing such as stapling processing (binding processing). In addition, the copy machine A and the bookbinding apparatus B can be used alone.

As shown in the figure, an image formation portion 3 is provided in an apparatus body 2 of the copy machine 1, and forms an image on a sheet such as ordinary paper and OHP. More specifically, an original feeding device 5 is mounted on an upper face of the apparatus body 2, an original automatically fed from the original feeding device 5 is read optically by optically reading means 7, and the read information is transmitted to the image formation portion 3 as a digital signal. In the image formation portion 3, based on the digital signal, light irradiating means 13 irradiates a surface of a photosensitive drum 15 with laser light L, and an electrostatic latent image corresponding to the original is formed on a surface of the photosensitive drum 15. Then, by rotation of the photosensitive drum 15, toner is supplied to the electrostatic latent image from a developing device 8 disposed around the photosensitive drum 15, and the electrostatic latent image is visualized. The visualized toner image is then transferred to a sheet S that is fed to a transfer portion 14 at predetermined timing. The sheet S to transfer to the image is fed to the transfer portion 14 for each sheet from a sheet cassette 9 installed under the apparatus body 2 by a feeding roller 10. The sheet can be fed also from a multi-tray 12.

The sheet S to which the toner image is transferred in the transfer portion 14 is conveyed to a fixing device 6, and the toner image undergoes permanent fixing by application of heat and pressure in the device 6. When a one-side mode is set in the apparatus body 2, the sheet S passed through the fixing device 6 is fed to the bookbinding apparatus B. Meanwhile, when a both-side mode is set in the apparatus body 2, the sheet S with the image formed on its one side is conveyed to a re-transport path 18 by switch back after being passed through the fixing device 6, conveyed to the image formation portion 3 again, where an image is formed on the other side, and is fed to the bookbinding apparatus B.

In addition, in order to enable the bookbinding apparatus B to beforehand perform switching between transport paths and the like, the apparatus body 2 transmits a signal of sheet size and the like to the bookbinding apparatus B before feeding the sheet S to the bookbinding apparatus B.

The bookbinding apparatus B is provided with at least a transport aligning portion 21 that conveys and aligns the sheet S, an adhesive applying portion 22 and a cutting portion 23, and capable of selecting an adhesion bookbinding mode and a cutting mode, as well as an ordinary discharge mode. In addition, cutting in the cutting mode is allowed in three directions except a bonded face of the sheet bundle S1 described later.

The transport aligning portion 21 is provided with a first transport path T1 that conveys the sheet S carried from the apparatus body 2, and a second transport path T2 and third transport path T3 that are branched from the first transport path T1. The first transport path T1 is provided with a carry-in roller pair 25, and a switching flapper 27 to switch between transport paths is provided at a branching portion of the second transport path T2 and the third transport path T3 downstream of the carry-in roller pair 25.

In such a form of transport paths, when the ordinary discharge mode is selected in the apparatus body 2, the sheet S carried into the bookbinding apparatus B from the apparatus body 2 via the first transport path T1 is guided to the third transport path T3 by the switching flapper 27, and discharged to the discharge tray 35 of the post-processing apparatus C via a plurality of feeding roller pairs 28 provided on the third transport path T3 (when necessary, discharged to the discharge tray 35 after undergoing the post-processing such as stapling). Meanwhile, when the bookbinding mode is selected in the apparatus body 2, the sheet S is guided to the second transport path T2 by the switching flapper 27, undergoes bonding bookbinding (for example, bookbinding by gluing) via the adhesive applying portion 22 and the cutting portion 23, and then, discharged to the storage portion 34.

Downstream of the second transport path T2 is provided a gathering portion 42 constituting an aligning region of the transport aligning portion 21. The gathering portion 42 is provided with a receiving portion 42*a* that receives the sheet S, a predetermined number of sheets S are placed while being inclined on the receiving portion 42*a*, and a single sheet bundle S1 is thereby formed. In this case, the receiving portion 42*a* is slidable in the placement direction of the sheet S (the thickness direction of the sheet bundle S1) by a sliding mechanism not shown, and fixed to an arbitrary slide position by a rack not shown. The gathering portion 42 is further provided with a pressing arm 52 that presses the sheet S against the receiving portion 42*a* and that is rotatable on a rotation axis 52*a*.

After the predetermined sheet bundle S1 is formed on the receiving portion 42*a*, the portion 42*a* is shifted a predetermined distance downwardly toward a first position P1 while maintaining the inclined posture to hold the sheets as shown by the arrows a and b in FIG. 1, and then, positioned in a second position P2 by being shifted a predetermined distance in the direction perpendicular to the first shift direction (in a downwardly slanting direction). Such shifts of the receiving portion 42*a* are carried out by a shift mechanism not shown specifically.

In the second position P2 are provided grippers (transport means) 55*a* and 55*b* that hold end portions of the sheet bundle S1 placed on the receiving portion 42*a*. The grippers 55*a* and 55*b* rotate the held sheet bundle S1 as shown by the arrow c in FIG. 1 to direct to a substantially vertical direction (let the sheet bundle S1 stand in the substantially vertical direction), and shift the sheet bundle S1 downwardly toward the adhesive applying portion 22 while keeping the substantially vertical state (with one end face (to which an adhesive is applied as described later) of the sheet bundle S1 down). More specifically, these grippers 55*a* and 55*b* are allowed to move between a holding position to hold the sheet bundle S1 in the second position P2 and a passing position to pass the sheet bundle S1 to the cutting device 23. Further, the grippers 55*a* and 55*b* are allowed to move between a close position to hold the sheet bundle S1 from both sides and an open position to release the holding state of the sheet bundle S1.

The case will be described below where the gathering portion 42 gathers sheets S to form the sheet bundle S1.

When the bookbinding mode is selected on the apparatus body 2 side, the sheet S discharged from the apparatus body 2 is guided to the second transport path T2 from the first transport path T1 via the carry-in roller pair 25 and the switching flapper 27, and then guided to the gathering portion 42.

The sheet S guided to the gathering portion is placed on the receiving portion 42*a* successively. In this case, whenever a singe sheet S is placed on the receiving portion 42*a*, the pressing arm 52 rotates on the rotation axis 52*a*, and presses the sheet S against the receiving portion 42*a*. The pressing force by the pressing arm 52 eliminates clearance between sheets S, forms an appropriate sheet bundle S1, and slides the receiving portion 42*a* together with the sheet bundle S1. The slide position of the receiving portion 42*a* is held by the rack mechanism, thereby reserving placement space for a next sheet S. In other words, as the number of sheets S gathered in the gathering portion 42 is increased (corresponding to the thickness of the sheet bundle S1), the pressing arm 52 slides the receiving portion 42*a*, and thus contributes to formation of the sheet bundle S1 with excellent alignment.

As described above, the sheet S is fed in the gathering portion 42 successively, and when a predetermined number of sheets S are gathered (a sheet bundle S1 with a predetermined thickness is formed), the receiving portion 42*a* is shifted to the second position P2 via the first position P1 by the shift mechanism. Then, in the second position P2, the sheet bundle S1 on the receiving portion 42*a* is held by the grippers 55*a* and 55*b* waiting in the open position, then rotated to the vertical direction, and shifted to the adhesive applying portion 22 while keeping the vertical state. In addition, the adhesive applying portion 22 is provided between the front cover bonding portion 60 provided downstream of the third transport path T3 described later and the second position P2.

The adhesive applying portion 22 is provided with an adhesion unit 66 that holds an adhesive (for example, glue) and applies the held adhesive to the end face of the sheet bundle S1, and a shift mechanism that shifts the adhesion unit 66 along the end face of the sheet bundle S1. The adhesion unit 66 is provided with, for example, an aluminum container (adhesive container) that stores an adhesive and has an upward opening, and an application roller 68*b* as a rotation member rotatably supported by the container 66*a*. In this case, the application roller 68*b* is comprised of, for example, heat-resistant rubber, comes into contact with the adhesive inside the container 66*a* to hold on its surface, and applies the adhesive held on the surface to the end face of the sheet bundle S1 while rotating.

The adhesion unit 66 is allowed to move by the shift mechanism among an application region (region in which the container 66 is positioned in FIG. 1) to apply the adhesive to the sheet bundle S1, a standby position to prepare for application processing after withdrawing from the transport path (substantially vertical transport path) of the sheet bundle S1, and a replenishment position to undergo replenishment of the adhesive (the adhesive is added through the opening of the container 66*a*) i.e. a position opposed to an adhesive replenishing device 90.

The case will be described below that the adhesive applying portion 22 applies the adhesive to the end face of the sheet bundle S1 fed by the grippers 55*a* and 55*b*.

The sheet bundle S1, which is descending while being sandwiched by the grippers 55*a* and 55*b* as described earlier, is positioned in a substantially vertical state in a predetermined position in the application region on the movement path of the adhesion unit 66. In this case, the clearance between the end face of the sheet bundle S1 and the application roller 68*b* is adjusted corresponding to the thickness of the sheet bundle S1.

When the sheet bundle S1 is thus positioned in the predetermined position in the application region, the adhesion unit 66 waiting in the standby position is next moved to a predetermined starting position in the application region. Then, the adhesion unit 66 is moved from the starting position to a predetermined return position on the sheet bundle S1 with the forwardly rotated application roller 68*b* brought into contact with the end face of the sheet bundle S1. The end face of the sheet bundle S1 is thus coated with the adhesive uniformly by the application roller 68*b* bearing the adhesive inside the container 66*a* on its surface.

When the adhesion unit 66 reaches the return position, the forward rotation of the application roller 68*b* is halted, and the movement of the adhesion unit 66 is also halted. From this point, the application roller 68*b* is reversely rotated next, and the adhesion unit 66 starts moving to the starting position from the return position. Then, when the adhesion unit 66 reaches the starting position again, the reverse rotation of the application roller 68*b* is halted, and the movement of the adhesion unit 66 is halted. Then, after the aforementioned reciprocating movement is carried out, for example, twice, the adhesive application operation is finished.

After finishing the application of adhesive to the end face of the sheet bundle S1, the adhesion unit 66 is moved to the standby position or the replenishment position to reserve the transport path for the sheet bundle S1. Subsequently, the sheet bundle S1 held by the grippers 55*a* and 55*b* descends to the front cover bonding portion 60 via the substantially vertical transport path (in the direction crossing the movement direction of the adhesion unit 66).

Figure 6:
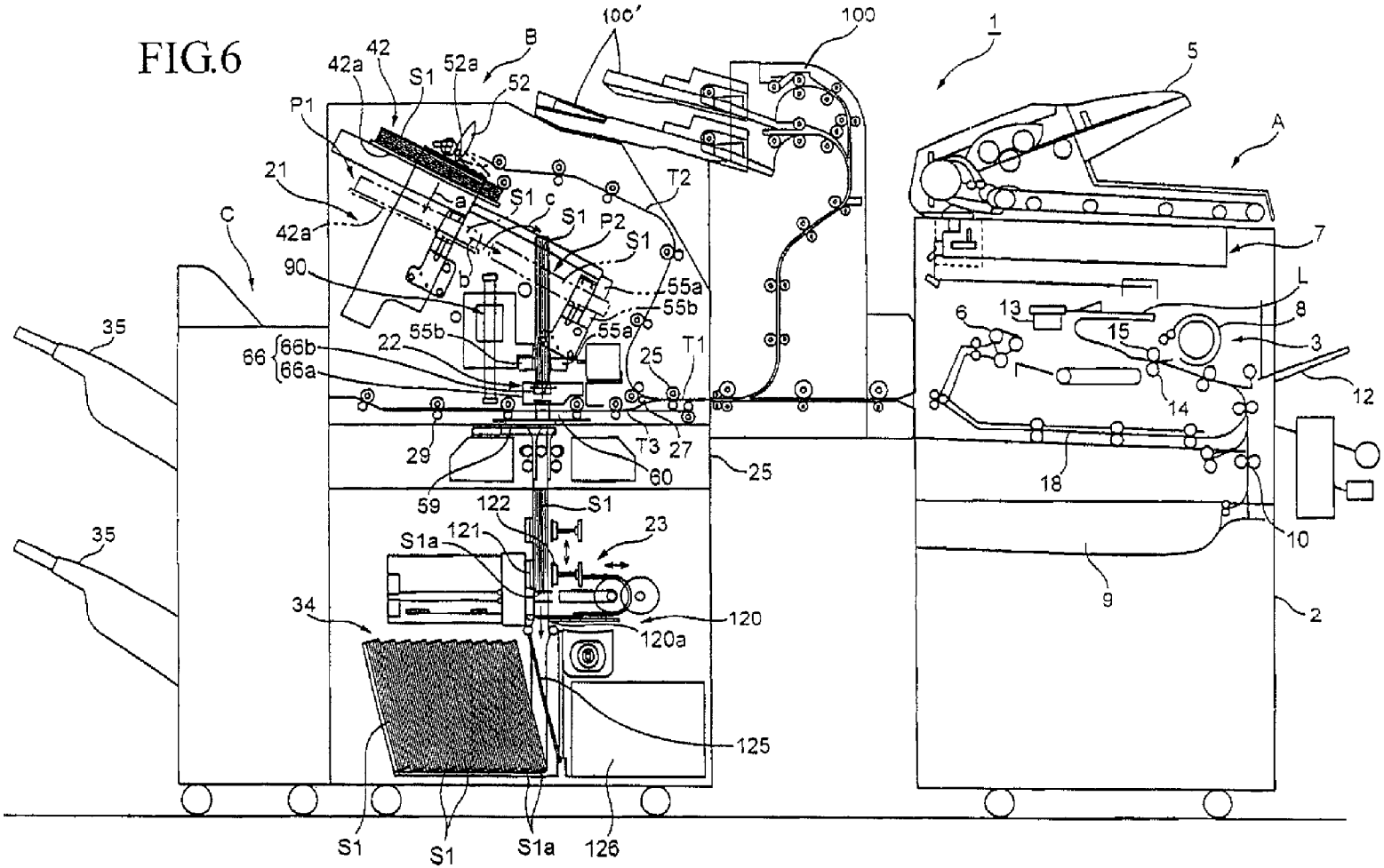
FIG. 6 shows a modification of the image formation processing system with an inserter between a copy machine and the bookbinding apparatus.

Meanwhile, a front cover has already been conveyed to the front cover bonding portion 60 and on standby until after the adhesive is thus applied to the end face of the sheet bundle S1. In this case, the front cover is drawn by a front cover supplying portion 100 from a front cover storage portion 100' (as shown in FIG. 6) which stores front covers and fed to the front cover bonding portion 60, or created in the apparatus body 2 and then fed to the front cover bonding portion 60 from the apparatus body 2. When the front cover is fed from the apparatus body 2 to the front cover bonding portion 60, the front cover is conveyed to the third transport path T3 from the first transport path T1 via the switching flapper 27, and positioned in a predetermined position in the front cover bonding portion 60 crossing the substantially vertical transport path of the sheet bundle S1. Then, the end face of the sheet bundle Si applied with the adhesion is pressed against the positioned front cover vertically from above the front cover by the grippers 55*a* and 55*b*. In this state, the sheet bundle Si is further moved in the vertically downward direction by the grippers 55*a* and 55*b* with the front cover bonded to the end face by the adhesive, and pressed against a slidable striking block plate 59 located under the front cover bonding portion 60. Then, the front cover and the sheet bundle S1 are pressed from both sides by a slidable back folding plate while being pressed against the striking block plate 59. Folds are thereby formed in the front cover corresponding to the thickness of the sheet bundle S1.

Next, the striking block plate 59 slides to the external side to form the transport path for the sheet bundle S1, and then the grippers 55*a* and 55*b* pass the sheet bundle S1 with the front cover bonded thereto to the cutting portion 23 located downward while holding the bundle S1.

The cutting portion 23 will specifically be described below with reference to FIGS. 2 to 5.

Figure 2:
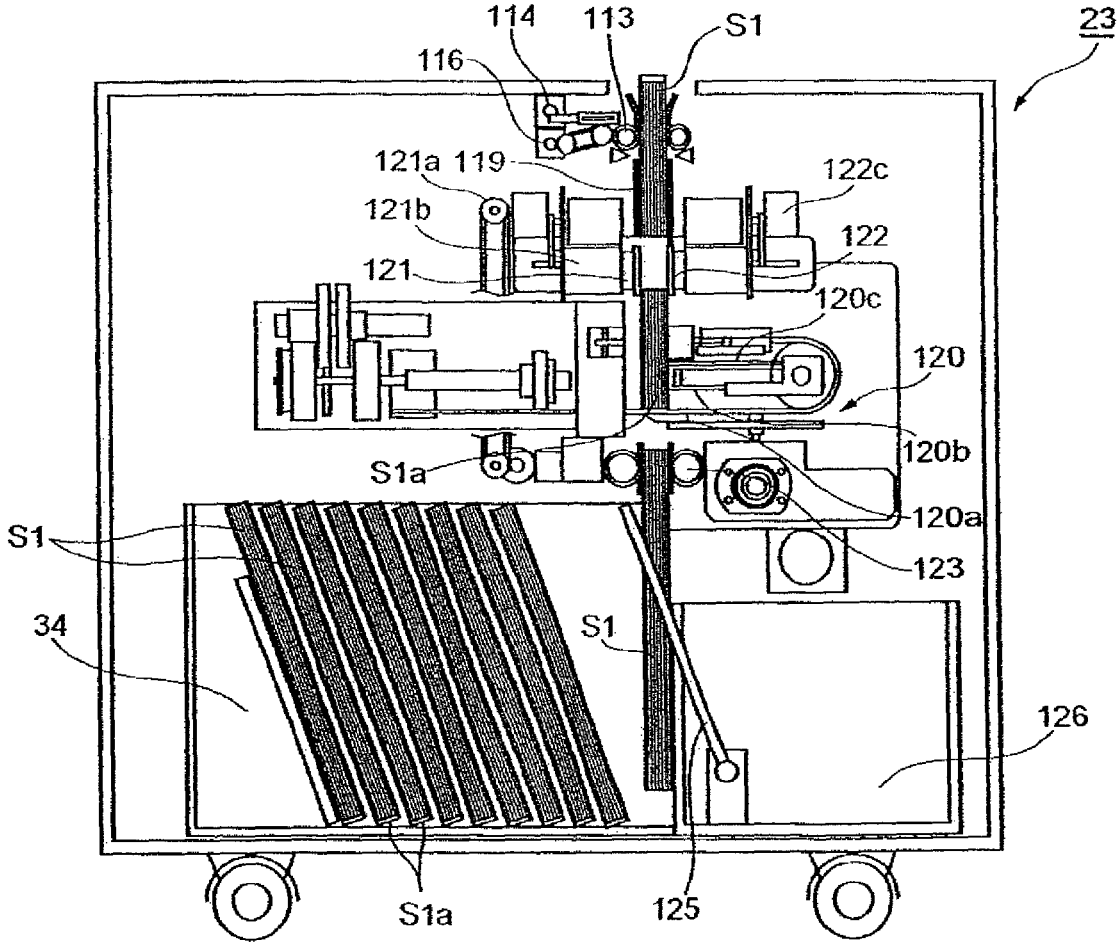
FIG. 2 is a view showing a schematic configuration of a cutting portion of a bookbinding apparatus in the bookbinding system shown in FIG. 1.
Figure 3:
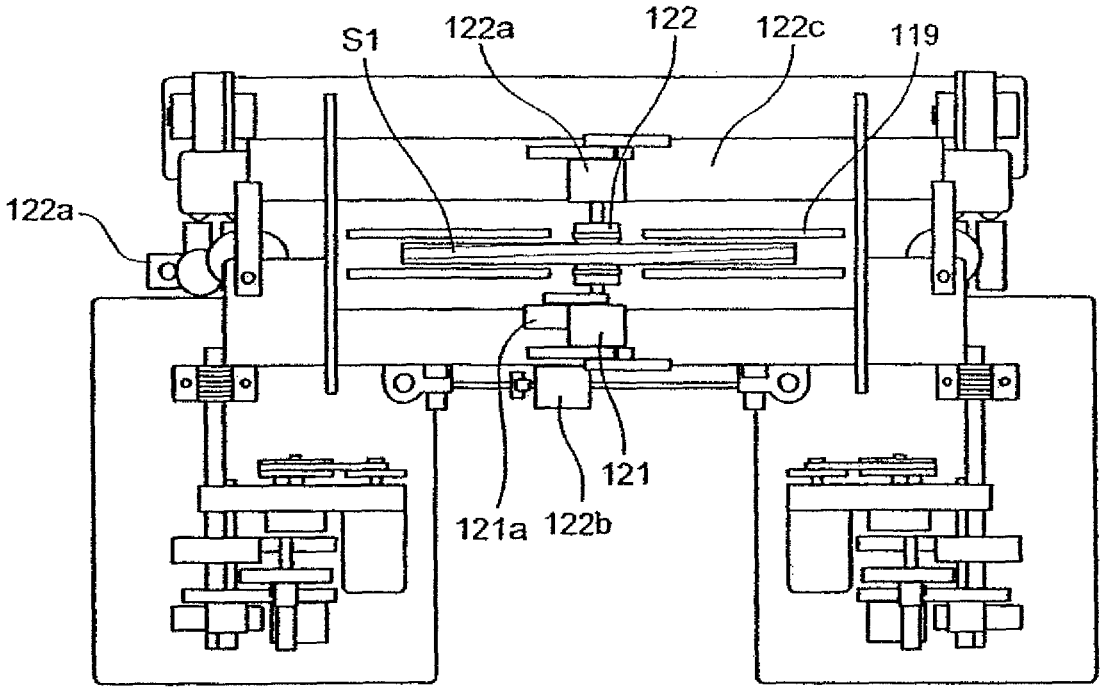
FIG. 3 is a plan view of the cutting portion of FIG. 2.
Figure 4:
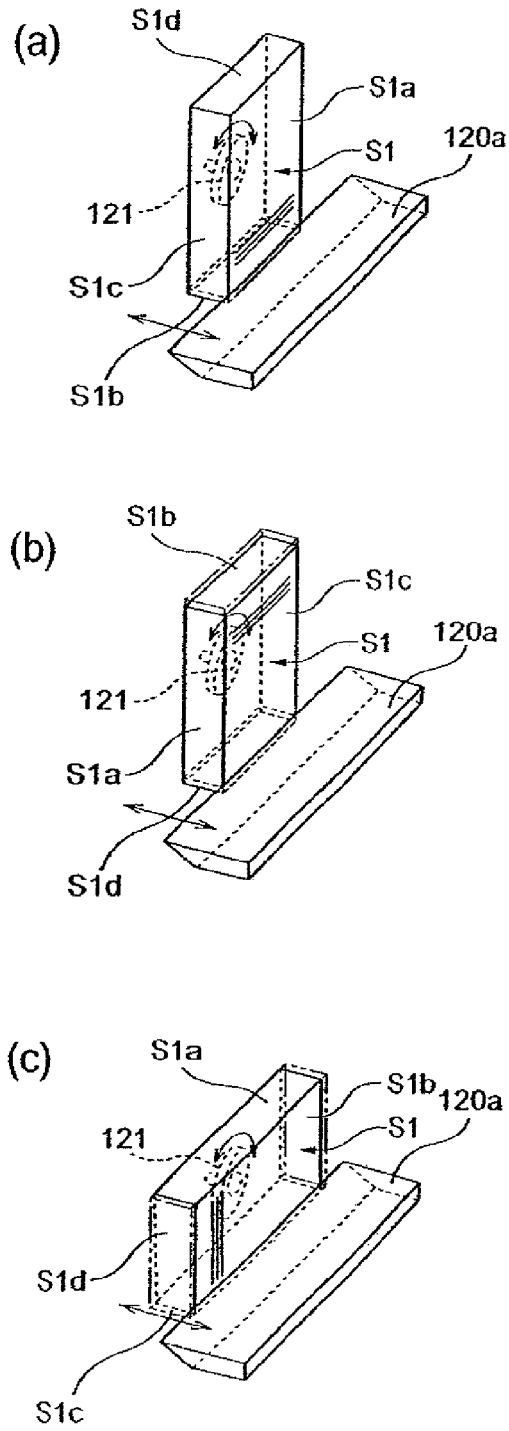
FIG. 4 is a perspective view illustrating steps of cutting procedure by a cutting blade.
Figure 5:
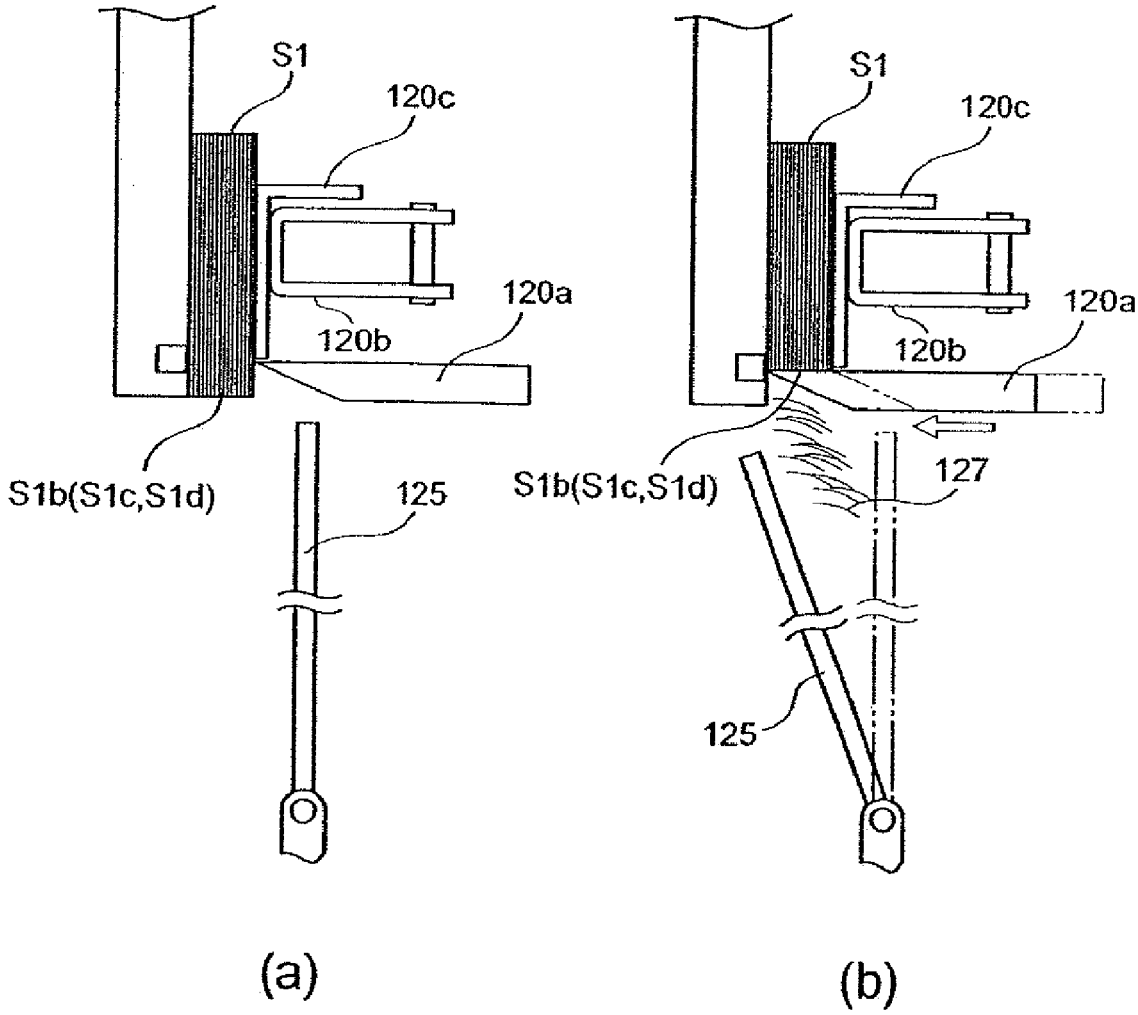
FIG. 5(*a*) shows the cutting portion and a flapper prior to cutting.

In FIGS. 2 and 3, "113" denotes an inlet transport roller, "120" denotes a cutting unit, "121" denotes a rotation table, "122" denotes a rotatable gripper that holds and fixes the sheet bundle S1 on the rotation table 121, "122*a*" is a gripper driving mechanism that presses the gripper 122 against the rotation table 121, "122*b*" is a gripper shift mechanism that shifts the gripper 122 in the direction of the cutting unit 120, and "122*c*" is a gripper frame that holds the gripper 122. The cutting unit 120 is provided with a cutting blade 120*a*, a movable pressing plate 120*b* that presses an edge portion of the sheet bundle S1 in cutting, a fixed pressing plate 120*c*, and a pressing plate shift mechanism that drives the plates.

When the sheet bundle S1 with the front cover bonded thereto is passed to the cutting portion 23 by the grippers 55*a* and 55*b*, a transport shift mechanism 116 is started to rotate the inlet transport roller 113, and the sheet bundle S1 is conveyed toward the cutting blade 120*b* in the vertical direction. In this case, the inlet transport roller 113 holds the sheet bundle S1 by being driven by a roller open/close shift mechanism 114.

Next, the sheet bundle S1 discharged from the inlet transport roller 113 is conveyed to the cutting blade 120*a* while being supported by guide plates 119 forming a substantially vertical transport path.

When the sheet bundle S1 is thus conveyed and reaches the cutting blade 120*a*, the gripper 122 is driven by the gripper driving mechanism 122*a*, and the sheet bundle S1 is held and fixed between the gripper 122 and the rotation table 121.

Next, based on thickness information of the sheet bundle S1, the cutting blade 120*a* moves to a predetermined position to form clearance required for the sheet bundle S1 to rotate and shift, and waits. Then, the rotation table 121 and the gripper 122 are driven via the gripper shift mechanism 122*b* and a rotation mechanism 121*a*, whereby the sheet bundle S1 held by the rotation table 121 and the gripper 122 is rotated and shifted from a state in which a back S1*a* as the end face to which the front cover is bonded faces downward to respective positions enabling the cutting blade 120*a* to cut the other end faces, an upside portion S1*b*, an end portion S1*c* and a downside portion S1*d*. In addition, FIG. 4(*a*) shows a state where the sheet bundle S1 is rotated and shifted to a position for the cutting blade 120*a* to cut the upside portion S1*b*, FIG. 4(*b*) shows a state where the sheet bundle S1 is rotated and shifted to a position for the cutting blade 120*a* to cut the downside portion S1*d*, and FIG. 4(*c*) shows a state where the sheet bundle S1 is rotated and shifted to a position for the cutting blade 120*a* to cut the end portion S1*c*.

In either case of cutting the end face S1*b*, S1*c* or S1*d*, the sheet bundle S1 held by the rotation table 121 and the gripper 122 is fixed to the cutting position, and the cutting unit 120 cuts the end face by control means not shown. More specifically, the control means drives the pressing plate moving mechanism, the movable pressing plate 120*b* is thereby moved, and an end face side of the sheet bundle S1 to be cut is held between the movable pressing plate 120*b* and the fixed pressing plate 120*b* (see FIG. 5(*a*)). Then, the cutting blade 120*a* is moved along an arc on the horizontal plane, and the end face is thereby cut and aligned (see FIG. 5(*b*)). At this point, cut waste 127 drops due to its own weight, and is stored in a waste box 126 by a flapper 125. More specifically, when the cutting is started, the control means (not shown) rotates the flapper 125 to a waste receiving position shown by solid lines in FIG. 5(*b*), and the cut waste 127 dropping under its own weight during cutting is stored in the waste box 126 by guide of the flapper 125. Such efficient collection of the cut waste 127 can be implemented due to the fact that the sheet bundle S1 is conveyed by the vertical transport path and cut. In addition, the flapper 125 is moved backed to the original position (the position shown by solid lines in FIG. 5(*a*); the position shown by dashed lines in FIG. 5(*b*)) whenever cutting of a single sheet bundle S1 is finished.

After one end face is cut, based on the thickness information of the sheet bundle S1, the pressing plate 120*b* and the cutting blade 120*a* move again to predetermined positions to form clearance required for the sheet bundle S1 to rotate and shift, and wait. Then, the rotation table 121 and the gripper 122 are driven again via the gripper shift mechanism 122*b* and the rotation mechanism 121*a*, the sheet bundle S1 held by the rotation table 121 and the gripper 122 is rotated (by) 180° and moved to a position enabling the cutting blade 120*a* to cut an end face to cut next.

When cutting of the three end faces is finished as described above, the rotation mechanism 121*a* is driven to move the rotation table 121 back to the original position, the gripper shift mechanism 122*b* is driven, and thereby, the sheet bundle S1 held by the gripper 122 and the rotation table 121 is conveyed to the storage portion 34 via a discharge roller 123. In this case, the sheet bundle S1 discharged from the discharge roller 123 is pushed into the storage portion 34 by the flapper 125, and stored and gathered while being allowed to stand substantially vertically with the end face S1*a* coated with the adhesive down.

As described above, according to this embodiment, the sheet bundle S1 is conveyed from the adhesive applying portion 22 to the storage portion 34 along the substantially vertical transport path while being allowed to stand in the substantially vertical direction. In other words, the sheet bundle S1 is conveyed along only the substantially vertical straight-line transport path over generally all the processes of the bookbinding processing, without being conveyed in various directions such as the vertical, horizontal and oblique directions in the bookbinding apparatus B. Therefore, it is not necessary to secure space to convert a posture of the sheet bundle S1 in the bookbinding apparatus B, and an area occupied by the transport path for the sheet bundle S1 is remarkably reduced in the bookbinding apparatus B, as compared with the conventional bookbinding apparatus that conveys the sheet bundle S1 in various directions such as the vertical, horizontal and oblique directions. Accordingly, it is possible to miniaturize the bookbinding apparatus B and largely reduce the manufacturing cost of the bookbinding apparatus B. Further, the sheet bundle S1 is maintained while being allowed to stand in the substantially vertical direction during transport from the adhesive applying portion 22 to the storage portion 34, and therefore, does not crumble.

Moreover, according to this embodiment, an adhesive is applied to an end face of the sheet bundle S1 while letting the sheet bundle S1 stand in the substantially vertical direction. In other words, it is possible to apply the adhesive to the end face of the sheet bundle S1 in the vertical direction, and it is not necessary to apply the adhesive from the side, thereby eliminating the need of devising the structure to prevent the adhesive to apply from leaking from the adhesive container 66*a* due to the effect of gravity. It is thus possible to simplify the structure of the adhesion unit 66 and coat the adhesive uniformly with excellence.

Further, according to this embodiment, the sheet bundle S1 applied with the adhesive is conveyed in the substantially vertical direction without being conveyed while lying. In other words, the sheet bundle S1 is conveyed in the direction perpendicular to the direction along the end face coated with the adhesive, and it is thus possible to prevent the end face of the sheet bundle S1 in transport from coming into contact with various members including side walls of the transport path. Accordingly, such a problem can be prevented that the adhesive applied to the end face of the sheet bundle S1 is removed. Further, the need is eliminated for taking measures against such a problem, not resulting in increases in size and cost of the apparatus.

Moreover, according to this embodiment, the sheet bundle S1 applied with the adhesive and bound is stored and gathered in the storage portion 34 while being allowed to stand in the substantially vertical direction. In this way, since the direction in which the adhesive applied to the sheet bundle S1 drips due to gravity is different from (substantially perpendicular to) the direction in which the sheet bundles S1 are gathered, even if the adhesive drips in the storage portion 34, the dripped adhesive is prevented from boding sheet bundles. Particularly in this embodiment, sheet bundles S1 are stored and gathered in the storage portion 34 with the end face coated with the adhesive down, and it is thus possible to almost reliably prevent the dripped adhesive from bonding sheet bundles S1.

Further, in this embodiment, since the sheet bundle S1 applied with the adhesive undergoes cutting of its end face while standing in the substantially vertical direction, the direction (vertical direction) of the adhesive dripping due to gravity is perpendicular to the cutting direction (shift direction) of the cutting blade 120*a*. Accordingly, as compared to the case where the adhesive dripping direction agrees with the cutting direction (shift direction) of the cutting blade 120*a* (the case where the sheet bundle S1 is cut while lying horizontally), occasions can be reduced extremely such that the adhesive dripped in cutting adheres to the cutting blade 120*a*, and it is made possible to minimize such an event that the adhered adhesive degrades subsequent cutting function of the cutting blade 120*a*.

Furthermore, in this embodiment, a front cover is bonded to the end face of the sheet bundle S1 applied with the adhesive (bonding is carried out such that the sheet bundle S1 is pressed against the front cover with the end face coated with the adhesive down), while letting the sheet bundle S1 stand in the substantially vertical. Therefore, even if the adhesive drips, the adhesive is received on the front cover, and the risk is eliminated of occurrences of trouble due to the adhesive adhering to other parts of the apparatus.

Moreover, in this embodiment, since the sheet bundle S1 is conveyed with the end face down on which the adhesive is coated, it does not happen that the adhesive is removed due to the fact that the end face of the sheet bundle S1 comes into contact with the transport path while the sheet bundle S1 is moved, without particularly securing large space for the transport path, or without providing specific equipment for precisely controlling an application amount of the adhesive. Accordingly, without resulting in increases in size and cost of the apparatus, it is possible to bond sheets constituting the sheet bundle S1 with reliability and bond the sheet bundle S1 and the front cover adequately. Further, such a failure does not occur that the adhesive adhered to the side wall of the transport path prevents transport of a subsequent sheet bundle S1. Furthermore, by facing the end face coated with the adhesive downwardly, it is possible to apply the adhesive from under the end face, and the adhesive container 66*a* can be released upwardly. Therefore, it is also made possible to replenish the adhesive in the adhesive container 66*a* in the gravity direction, facilitating replenishment of the adhesive.

FIG. 6 shows a modification of the image formation processing system with an inserter between the copy machine and the bookbinding apparatus.

The present invention is not limited to the above described embodiment, and various variations and modifications may be possible without departing from the scope of the present invention. As described above, in the image formation processing system, a plurality of sheets is supplied from the copy machine A to the bookbinding apparatus B to form a sheet bundle. As shown in FIG.6, however, a plurality of sheets with images already added thereto may be supplied from the front cover supplying portion (also referred to as an inserter or a sheet supplying portion) 100 to the bookbinding apparatus B to form a sheet bundle. Also in this case, the bookbinding apparatus B is disposed downstream of the front cover supplying portion 100 in sheet transport, and the post-processing apparatus C is disposed downstream of the bookbinding apparatus B in sheet transport. Further, in the above-mentioned embodiment the post-processing apparatus C is disposed as a sheet receiving portion downstream of the bookbinding apparatus B in sheet transport, but a simple storage tray without the post-processing function may be disposed, substituting for the post-processing apparatus C. In other words, in the present invention, a sheet receiving portion disposed downstream of the bookbinding apparatus B in sheet transport may be configured as a post-processing portion which gathers received sheets in the shape of a bundle to form a sheet bundle and performs predetermined post-processing on the sheet bundle, or as a simple storage tray without the post-processing function.

The present invention is applicable to a bookbinding apparatus for placing a sheet with an image formed thereon on a tray and binding a bundle of placed sheets and to an image formation processing system provided with such bookbinding means, and thus has industrial applicability.

What is claimed is:

1. A bookbinding apparatus which gathers a plurality of sheets in the shape of a bundle to form a sheet bundle and binds the sheet bundle, comprising:

a sheet receiving portion which collects the sheet bundle;

an adhesive applying portion which applies an adhesive to an end face of the sheet bundle allowed to stand in a substantially vertical direction;

a first transport portion which conveys the sheet bundle in a substantially vertical direction from the sheet receiving portion to the adhesive applying portion;

a cutting portion which is provided on the transport path under the adhesive applying portion, the cutting portion which cuts an end face of the sheet bundle while letting the sheet bundle stand in the substantially vertical direction, and a second transport portion which conveys the sheet bundle while letting the sheet bundle stand in the substantially vertical direction from the adhesive applying portion to the cutting portion along a substantially vertical transport path.

2. A bookbinding apparatus of claim 1, further comprising:

a front cover bonding portion which is provided on the transport path between the adhesive applying portion and the cutting portion, the front cover bonding portion which bonds a front cover to the end face of the sheet bundle applied with the adhesive while letting the sheet bundle stand in the substantially vertical direction.

3. A bookbinding apparatus according to claim 2, wherein the front cover bonding portion includes a striking block plate to slide from a first position where the sheet bundle together with the front sheet are pressed against the strike block plate to a second position where the sheet bundle covered with the front sheet are allowed to move to the cutting portion.

4. A bookbinding apparatus according to claim 1, wherein the second transport portion conveys the sheet bundle with the end face applied with the adhesive down.

5. A bookbinding system comprising:

an image formation apparatus that forms an image on a sheet; and a bookbinding apparatus which receives a plurality of sheets with images transferred thereto from the image formation apparatus, gathers received sheets in the shape of a bundle to form a sheet bundle, binds the sheet bundle, and allows the sheet bundle to stand in a substantially vertical direction, wherein the bookbinding apparatus comprises:

a sheet receiving portion which collects the sheet bundle;

an adhesive applying portion which applies an adhesive to an end face of the sheet bundle;

a first transport portion which conveys the sheet bundle from the sheet receiving portion to the adhesive applying portion;

a cutting portion which is provided on the transport path under the adhesive applying portion, the cutting portion which cuts an end face of the sheet bundle while letting the sheet bundle stand in the substantially vertical direction; and a second transport portion which conveys the sheet bundle while letting the sheet bundle stand in the substantially vertical direction from the adhesive applying portion to the cutting portion along a substantially vertical transport path.

6. A bookbinding system according to claim 5, further comprising:

a front cover bonding portion which is provided on the transport path between the adhesive applying portion and the cutting portion, the front cover bonding portion which bonds a front cover to the end face of the sheet bundle applied with the adhesive while letting the sheet bundle stand in the substantially vertical direction.

7. A bookbinding system according to claim 6, further comprising:

a front cover storage portion which stores the front cover; and a front cover supplying portion which draws out the front cover from the front cover storage portion to supply to the front cover bonding portion.

8. A bookbinding system according to claim 6, wherein the front cover created in the image formation apparatus is supplied to the front cover bonding portion.

9. The bookbinding system according to claim 6, wherein the front cover bonding portion includes a striking block plate to slide from a first position where the sheet bundle together with the front sheet are pressed against the strike block plate to a second position where the sheet bundle covered with the front sheet are allowed to move to the cutting portion.

10. A bookbinding system comprising:

an image formation apparatus that forms an image on a sheet; and a bookbinding apparatus which receives a plurality of sheets with images transferred thereto from the image formation apparatus, gathers received sheets in the shape of a bundle to form a sheet bundle, binds the sheet bundle, and allows the sheet bundle to stand in a substantially vertical direction, wherein the bookbinding apparatus comprises:

a sheet receiving portion which collects the sheet bundle;

an adhesive applying portion which applies an adhesive to an end face of the sheet bundle;

a first transport portion which conveys the sheet bundle from the sheet receiving portion to the adhesive applying portion;

a cutting portion which is provided on the transport path under the adhesive applying portion, the cutting portion which cuts an end face of the sheet bundle while letting the sheet bundle stand in the substantially vertical direction; and a second transport portion which conveys the sheet bundle while letting the sheet bundle stand in the substantially vertical direction from the adhesive applying portion to the cutting portion along a substantially vertical transport path, wherein the second transport portion conveys the sheet bundle with the end face applied with the adhesive down.

* * * * *

UNITED STATES PATENT AND TRADEMARK OFFICE

CERTIFICATE OF CORRECTION

PATENT NO. : 7,954,799 B2
APPLICATION NO. : 12/709869
DATED : June 7, 2011
INVENTOR(S) : Hiroki Honmochi et al.

It is certified that error appears in the above-identified patent and that said Letters Patent is hereby corrected as shown below:

In Claim 1:
Column 13, line 66: please delete “the transport path” and substitute --a transport path--.

In Claim 5:
Column 14, line 43: please delete “the transport path” and substitute --a transport path--.

In Claim 10:
Column 16, line 7: please delete “the transport path” and substitute --a transport path--.

Signed and Sealed this
Fifth Day of July, 2011

David J. Kappos

David J. Kappos
*Director of the United States Patent and Trademark Office*